US006383118B1

(12) United States Patent
Nestoiter

(10) Patent No.: US 6,383,118 B1
(45) Date of Patent: May 7, 2002

(54) BALANCE BEAM

(76) Inventor: Alexander Nestoiter, 1616 N. Poinsettia Pl., #332, Los Angeles, CA (US) 90046

( * ) Notice: Subject to any disclaimer, the term of this patent is extended or adjusted under 35 U.S.C. 154(b) by 0 days.

(21) Appl. No.: 08/832,526

(22) Filed: Apr. 3, 1997

(51) Int. Cl.[7] ..... A63B 23/04
(52) U.S. Cl. ..... 482/23; 482/35
(58) Field of Search ..... 128/845; 72/253, 72/224, 235, 223; 482/23, 34, 4; 52/720.1, 740.4, 740.6, 740.3

(56) References Cited

U.S. PATENT DOCUMENTS

| | | | | | |
|---|---|---|---|---|---|
| 277,036 | A | * | 5/1883 | Hyde | 72/224 |
| 971,003 | A | * | 9/1910 | Gilbride | 482/34 |
| 1,747,721 | A | | 2/1930 | Lowman | |
| 1,750,833 | A | * | 3/1930 | Carns | 52/720.1 |
| 3,083,964 | A | * | 4/1963 | Wentzel | 482/34 |
| 3,580,568 | A | | 5/1971 | Stone | 272/60 |
| 3,582,068 | A | | 6/1971 | Hallgren et al. | 272/60 |
| 3,589,716 | A | | 6/1971 | Footlik | 272/60 |
| 3,707,286 | A | * | 12/1972 | Spieth et al. | 482/41 |
| 4,487,413 | A | * | 12/1984 | Full | 482/23 |
| D308,698 | S | * | 6/1990 | Dorman | 482/34 |
| 5,180,349 | A | | 1/1993 | Marcus | 482/34 |

FOREIGN PATENT DOCUMENTS

| | | | |
|---|---|---|---|
| FR | 636080 | * | 3/1928 |

* cited by examiner

*Primary Examiner*—Jerome W. Donnelly
(74) *Attorney, Agent, or Firm*—Small Larkin, LLP

(57) ABSTRACT

A beam having a triangular cross-section, with concave inward side walls forming substantially an equilateral triangle in cross-section, with a convex curved apex at the intersection of each of the three walls, the convex curved apex being formed of a rubber-like material and each having a different radius of curvature to thereby provide a rounded walking surface, each walking surface providing a different degree of difficulty and resulting in a different applied pressure to the foot of the user upon walking along the length of the beam.

13 Claims, 8 Drawing Sheets

24
26
38
20
32
36
28
42
22
34
40
30

46
60
60
44
52
62
64
58
66
54

60
62
66
64
66
60
64
62
48
50
60
56
60
68

BALANCE BEAM

BACKGROUND OF THE INVENTION

A. Field of the Invention

The present invention is directed to a beam upon which a person may walk and is useful to the fields of exercise, amusement, games and is believed to be useful in the fields of reflexology, kinesiology, motor skills, neurology and therapeutic medicine.

B. Description of the Prior Art

Although balance beams are well known in the field of gymnastics, such balance beams are typically of a square or rectangular cross-section, are, in typical use, positioned several feet above the ground and have had no known useful application in the fields of reflexology, neurology and therapeutic medicine. It is believed that a device as described and claimed herein has not been known prior to the present invention.

OBJECTS AND SUMMARY OF THE INVENTION

It is an object of the invention to provide a device for self-administered, hands-free deep tissue foot massage.

It is an object of the invention to provide a balance beam having a range of challenge levels for conditioning, training, and enhancing the balancing skills, which in turn, improve poise, body control, performance in dance, yoga, martial arts, and other sports.

It is an object of the invention believed to provide a balance beam capable of altering brain waves by means of vestibular stimulation, that is, without the use of medication or biofeedback.

It is an object of the invention to provide a specific walking surface structure which is believed to have the capability to positively enhance the neurological system by conditioning, learning, and improving muscular response to brain signals.

It is an object of the invention to provide a balance beam amusement device which is capable of simulating the experience of high, tight wire walking, but only inches off the floor and in the safety and comfort of home, gym or work place.

It is an object of the invention to provide balance beam units which may be joined or positioned on the floor and connected together to present walking surfaces of variable length, and/or a square, L-shape, or other configuration or path when joined.

It is an object of the invention to provide a balance beam which, during use is capable of conditioning and exercising the ankle and calf muscles.

It is an object of the invention to provide a balance beam which, during use is capable of stretching, flexing, and strengthening the joints of the foot and ankle.

It is an object of the invention to provide a balance beam, which during use is capable of enhancing learning, conditioning, and improving gross and fine motor skills.

The walking beam of the present invention is directed to providing a specific type of balance beam having a rounded surface upon which the user walks. This surface has the appearance of an arc, and, in cross-section, appears to be like an arc of a pipe. The degree and precise nature of the curvature may be varied within the scope of the invention, from a rather flat curvature, i.e., a large radius of curvature, to a sharp curve, i.e., a small radius of curvature. The length of the beam may vary. The beam is designed to facilitate and accommodate various specific walking surfaces.

The walking beam of the present invention has at least one rounded walking surface incorporated into and supported by a bar, or frame. The present invention beam has several primary benefits. The option for different walking surfaces provides for increasing the challenge level for balance walking among different individuals. This feature is provided by varying the radius and size of the walking surface, all of which have been determined to approximate the pressures applied by a reflexologist while performing deep tissue foot message for a range of user weights and degrees of difficulty and, as such has novel uses preferably for adults. The maximum benefit results when the user is standing or walking barefoot or in socks only. Users of differing weight, different feet size and using different positions while standing on the walking beam, determine the amount of pressure applied to the bottom of the foot, by virtue of the body weight pressing against the narrow walking surface of the beam. Preferably, three different walking surfaces are provided, wherein each of the three different walking surfaces is rounded to a different radius or curvatures in the foot contact area of the walking surface thereby providing a range of progressive levels of difficulty. Thus, the different radiuses for the different walking surfaces provide the user with a variety of applied pressure levels available to suit the individuals user's preference.

The present invention includes, preferably both triple beam and single beam embodiments. Both types of embodiments of the invention may be manufactured to permit the walking surfaces to be formed as replaceable inserts for use with the same frame. This feature provides users with a variety of options to fit their needs, for example the walking surface of the inserts may be rounded to various radiuses to form simple circular curves, to have complex curves or to be cut to other profiles but with the same anchor so as to be accommodated by a single frame. The inserts also may be made of different materials, such as plastic, wood, rubber, and so forth as well as having different textures on the walking surface itself.

The simplicity of the design of the present invention provides for relatively few number of parts, ease of assembly, ease of manufacturing and provides for a multitude of functions and features.

Therapeutic benefits of any product, including the present invention, may be derived through end users use and enjoyment of the product. Many balancing devices are known and many such products have been marketed to institutional sporting organizations. The design of the present invention, however, in addition to the structural, and functional advantages described herein, has a unique, contemporary shape, may be made of contemporary materials such as aluminum alloys, plastics, high grade wood, natural stone and other materials to provide an overall aesthetic and pleasing appearance. Furthermore, the side panel feature of the present invention provides ample space to apply graphics, art work, logos and other visual materials so as to provide the capability of the product to be very desirable from a visual or ornamental perspective.

The unique shape of the present invention, both triple beam and single beam embodiments, permit the product to be made of transparent materials such as plastic. This capability provides additional distinct qualities not found in any known balance beam.

For example, if the beam frame is made of transparent material and is placed on a floor mat that has art work depicting scenes which create the perception of looking down, the transparent material of the stand would compliment the art work by enhancing the visual illusion and the depth perception of the objects depicted on the mat. Also, the transparent material of the frame of the balancing beam permits and provides space within which to house replaceable inserts, the inserts which may have art work, logos and other visual materials imprinted thereon and be chosen to compliment the illusion. Accordingly, the balancing beam may have a wide variety of different appearances and provide for great ease in achieving different appearances. Also, the clear material has an attractive visual or ornamental appeal when fashioned into a balance beam of the present invention.

Both the single and triple stand embodiments of the present invention may be manufactured by conventional means, preferably by use of extrusion technology, with plastic, aluminum or other extrudable materials as the preferred materials of construction. The structures of the present invention may also be fabricated out of wood, particle board, granite, marble, other metals and virtually any other non-toxic material which has sufficient strength to maintain its shape during use.

DESCRIPTION OF THE PREFERRED EMBODIMENTS

Figure 1:
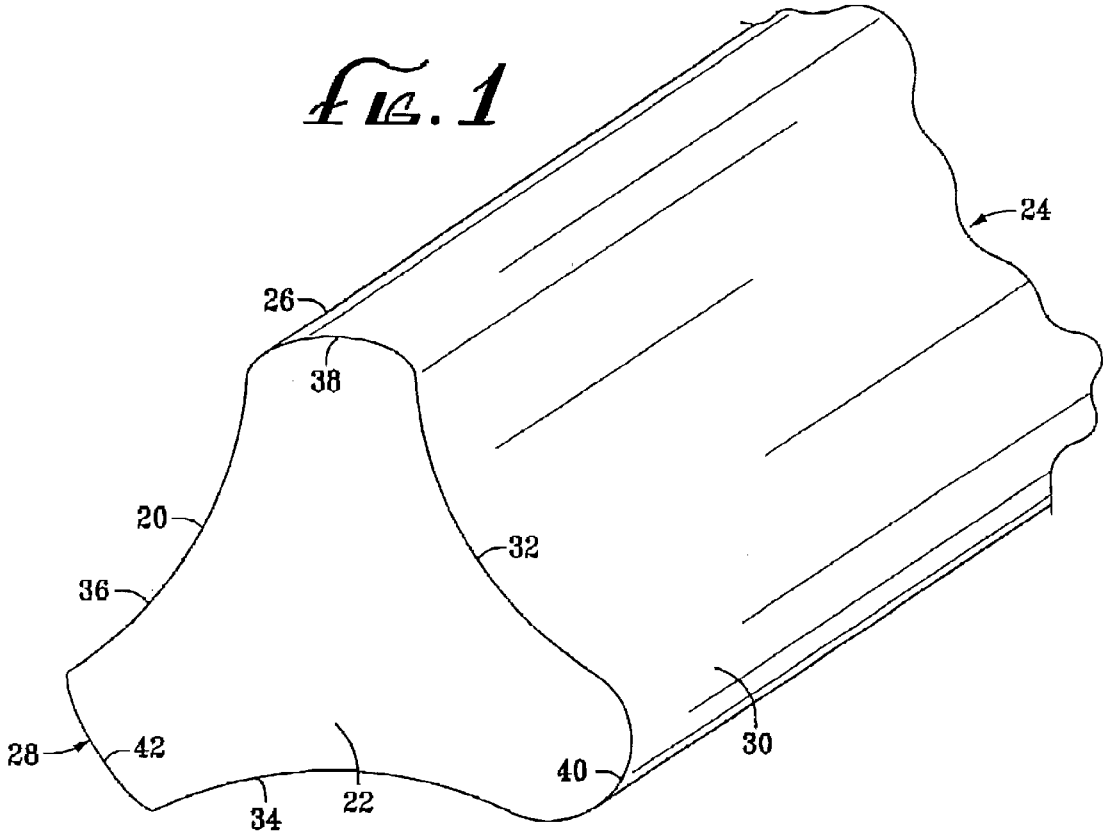
FIG. 1 is a side, perspective view of a preferred embodiment of the invention.

Referring to FIG. 1, one embodiment of the present invention is shown as an elongated balance beam or stand 20. This embodiment has a cross-section which is based on the geometry of the equilateral triangle, has a predetermined length, such as 2 feet to 70 feet, preferably, four (4) feet and has at each apex of the triangle, a rounded edge. Preferably the radius of curvature of each edge is different. Each edge provides a surface to be walked on, and is referred to as a walking surface. In this form of the invention, the beam or stand 20 may be referred to as a triple beam or triple stand. The triple beam 20 includes three convex, elongated walking surfaces or edges 26, 28 and 30 which extend from a first end 22 to a second end 24 of the beam. Connecting and extending between each of the convex walking surfaces are concave side panels or walls 32, 34 and 36. The embodiment shown in FIG. 1 provides a stable base regardless of which side is placed on the floor. The curvature of the walking surfaces 26, 28 and 30 may be the same, but preferably are different. Preferably, the concave inward curvature of the side panels is the same for each side wall 32, 34 and 36, thus causing the beam to resemble, in cross-section, the shape of the Bell Curve and, thus, the design of this shape may be referred to as the Bell Curve Therapeutic Stand.

By placing the stand 20 with its side panel 34 facing the floor, the surface 26 faces upward, to provide a walking surface. Alternatively, placing the beam 20 such that the side wall 32 faces the floor, causes the surface 28 to face upward, and to function as the walking surface.

Alternatively, placing the beam 20 such that side wall 36 faces the floor, causing surface 30 to face upward and function as the walking surface.

Figure 2:
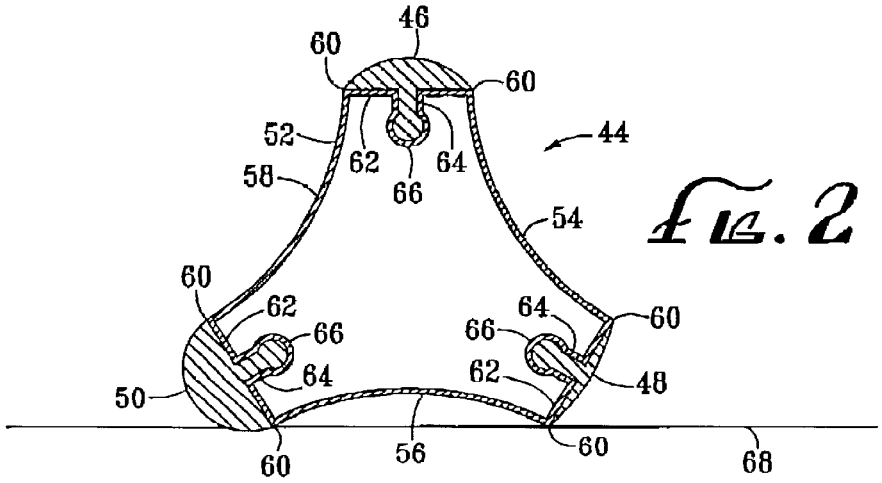
FIG. 2 is a cross-sectional view of an alternate embodiment of the present invention.

As may be appreciated, providing the side panels 32, 34 and 36 to be formed concave inward to the center of the stand, adds strength to the design. The concave, equilateral triangle-based design of FIG. 1 provides for a stable, well-centered placement of the stand even on soft and/or uneven surfaces such as floor carpeting, rugs, floor mats, sand and so forth. The concave feature of the side wall also functions to effectively place the side panels farther away from a users toes or heals during use, i.e., when walking or balancing on the beam and, thereby functions to increase the challenge level of walking or balancing on a beam, in comparison to a beam of a square or rectangular cross-section. Furthermore, the triple concave side panels add an aesthetic feature to the appearance of the stand. The beam 20 as shown in FIG. 1 can be solid or hollow. Depending on the material used, the frame of stand can be produced either solid or hollow. Materials such as aluminum and strong grades of plastic are sufficiently structurally sound and provide ample weight bearing capacity, even when extruded to be hollow and with thin walls for the hollow beam. Various grades of foamed plastic or rubber can be used to produce the shape either solid, or for semi-solid models, using thick walls. FIG. 2 shows a hollow, thin wall embodiment. Walking surfaces could be either part of the main frame and be of the same material, or they could be made from a different material and assembled with the main frame, as shown in FIG. 2. The preferred length is 48". For institutional and special users product lengths as long as 70 feet may be preferred.

As shown in FIG. 1 the radius of curvature 38 of walking surface 26 is greater than the radius of curvature 40 associated with adjacent walking surface 30, and is smaller than the radius of curvature 42 of adjacent walking surface 28.

Referring to FIG. 2, an alternate embodiment triple stand 44 is shown. This embodiment has three different walking surfaces 46, 48 and 50, with the walking surfaces being formed as inserts to be positioned with coordinating channel formed in the main frame 52 of the triple stand 44. Each of the walking surfaces 46, 48 and 50 is an elongated insert having the same length as the frame, and is anchored into the main frame 52 in the channel formed at 64 in the surface 62 of the frame and extends along the length of the frame 52. Frame 52, as shown in FIG. 2, has a triple, equal length and equal radius concave side walls 54, 56 and 58. Referring to top, or walking surface 46 as shown in FIG. 2, the concave side wall 54 is joined to adjacent concave side wall 58 at corner 60, flat wall or surface 62 which has an anchor channel 64 extending down into the frame and lengthwise along its longitudinal center line. The anchor channel 64 has a relatively narrow mid-portion and ends in expanded base or bulb 66.

The overall height of the triple stand 44, as shown in FIG. 2 approximates four inches (4"), and has a preferred width of approximately 1.25 inches, shown as dimension 61. This dimension is the same for all three legs of the triple beam. The most preferred radius of curvature of the walking surface is about 0.75 inches and was determined from calculations using an average person's weight, and the pressure the weight would generate on the person's feet standing on the outer, or upper edge of the walking surface. A wider surface, i.e. greater radius of curvature, would increase the contact area between the foot and the walking surface, thereby reducing the applied pounds per inch pressure on the foot while the average user was walking bare foot on the walking surfaces of the triple stand having the 0.75 inch radius. A narrower surface, and consequently less roundness, would reduce the contact area between the foot and the walking surface of the triple stand, thereby increasing the applied pounds per square inch pressure on the foot for the average person. The degree of narrowness and roundness of the walking surfaces of the present invention is therefore, chosen to be within a range so as to not be so narrow so the applied pounds per square inch pressure on the foot would be so high that the walking experience would be uncomfortable, painful and or otherwise not useful. In accordance with the present invention, the useful range of radius is about 0.375" to about 1.94", and the preferred range is about 0.50" to about 1.00", with the 0.75" radius believed to be the best radius for most uses for the average person.

Referring to the embodiments of FIGS. 1 and 2, the equilateral triangle based triple stand provides three different walking surfaces, each rounded to a different radius. The different radius for each walking surface serves two purposes. First, it provides for a way for the user to vary the degree of difficulty with a single product, and, secondly, provides for varying the applied pressure the foot receives when walking on the beam with bare feet, socks only or soft-soled shoes.

Further with respect to FIG. 2, the walking surfaces 46, 48 and 50 are made in the form of an insert, with the top or walking surface having a predetermined radius of curvature. As shown in FIG. 2 the radius of curvature of the outer surface of each of the inserts 46, 48 and 50 is different. Also, the inner portion or anchor of each of the inserts 46, 48 and 50 are identical and contoured to provide a tight, or snug fit within the channels of the frame, as illustrated at 64 and 66 the channels being of the same dimensions for all three legs of the frame. Because the dimensions of the channels 64 and 66 are the same for all three legs of the frame, the inserts 46, 48 and 50 are interchangeable. For example, many different inserts, each with a different radius of curvature could be manufactured for a wide range of degrees of difficulty, and each would be insertible in the channels 64 and 66. As is also shown in FIG. 2, it is the points or corners 60 which rest on the floor 68 when their connecting side wall faces the floor.

Figure 3:
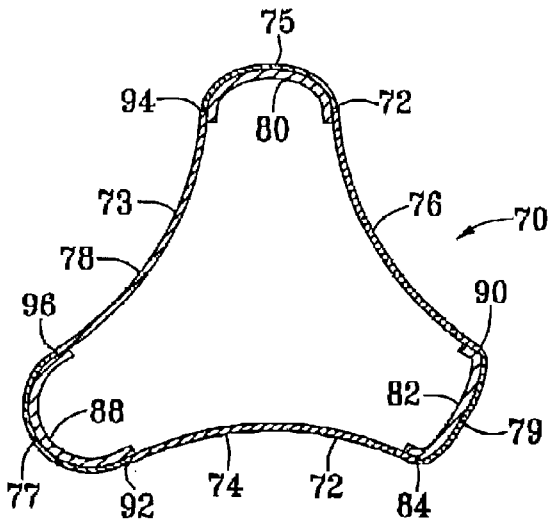
FIG. 3 is a cross-sectional view of another alternate embodiment of the present invention.

Referring to FIG. 3, another preferred embodiment of the invention is disclosed, with the FIG. 3 embodiment presently being most preferred. The triple beam 70 includes a main frame 72 with triple, equally concave walls 74, 76 and 78. Each of the walking surface portions 80, 82 and 88 of the frame 70 may be of the same, or different curvature. Also, each of these walking surface portions of the frame are formed, preferably, integrally with the frame, as by a mold or extrusion process. Preferably, on top of each walking surface portion of the main frame a strip of skid resistant tape or other material is affixed. As shown in FIG. 3, these strips 75, 77 and 79 are affixed along the length of the frame to provide the walking surface. The thickness of the tape or the strip is chosen so as to provide, preferably, an overall smooth profile. Thus, the surfaces of the frame should be recessed somewhat, so as to provide space to accommodate the thickness of the tape. The texture of the tape can vary from very smooth to bumpy, to indented with certain and/or random patterns, art work, logos, slogans and so forth. To assist users in identifying the walking surfaces, the tape on each walking surface could be of a different color and/or have some other marking.

If the thickness of the skid resistant tape is, for example 1/32 inch, then the surface on which it will be affixed, such as for example by glue, should be offset to correspond or allow for the thickness of the tape.

In addition to covering the outer surface of the frame at each apex, and providing skid-resistance for contact area with the foot/shoe, the walking surface tape also provides for making the experience of walking barefoot on the walking surface more comfortable, due to the cushioning quality and thickness of the tape.

When placed on a hard floor such as hardwood, linoleum, marble, or the like, the contact between the floor and the triple beam will be the corners or edges of the side panels, such as shown at points 82 and 84 when surface 75 functions as the walking surface. Rotation of the triple beam 70 to either of the other two orientations will provide for corresponding corners to provide the contact to the floor, with corresponding surfaces 77 or 79 functioning as the walking surface. The areas or regions where the skid-resistant tape covers the adjacent areas of the side panels or walls 73, 74 and 76 are shown at 90 and 84, 72 and 94, 96 and 82. This feature equips the triple stand with a skid resistant material in the contact area between the floor and the triple stand, and functions to prevent the stand from sliding, or skidding when in use.

Figure 4:
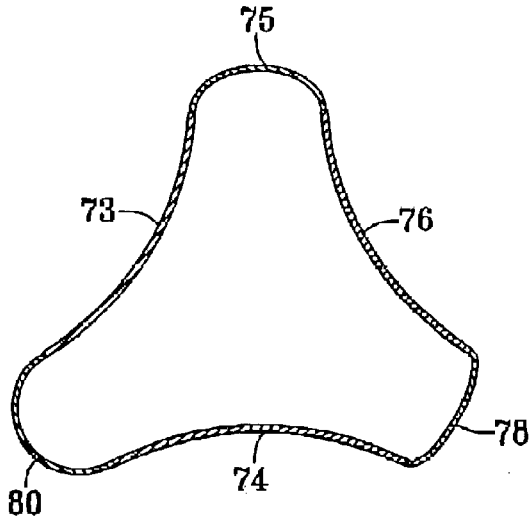
FIG. 4 is another view of the FIG. 3 embodiment of the present invention.

Referring to FIG. 4, the triple stand of FIG. 3 is shown so as to illustrate an overall smooth and even profile at the interface between the strips of skid-resistant material at the three walking surfaces 75, 78 and 80 and the convex side walls 73, 74 and 76.

The embodiment of FIGS. 3 and 4 are most preferred because, from a manufacturing perspective, the process applying the strip on the core or frame of the triple stand may be automated and also results in fewer number of parts for the balance beam.

Figure 5:
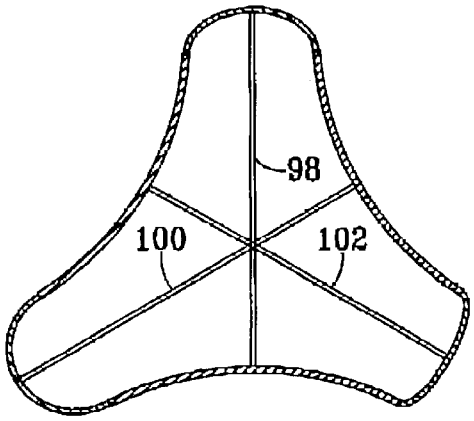
FIG. 5 is a cross-sectional view of another alternate embodiment of the present invention showing a particular type of inner support of struts.
Figure 6:
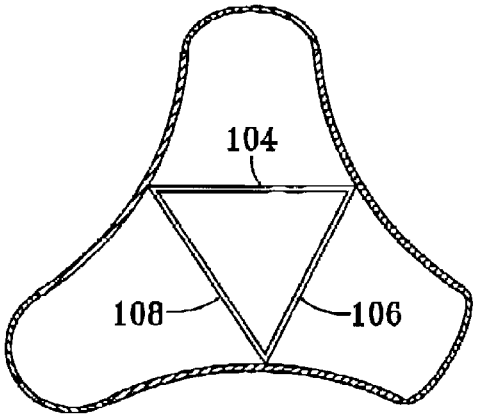
FIG. 6 is a cross-sectional view of another alternate embodiment of the present invention showing an alternate form of support of inner struts.

Referring to FIGS. 5 and 6, the triple stand may have a variety of supportive inner struts, beams or webs. For example, as shown in FIG. 5, inner struts 98, 100 and 102 are shown extending between the center of the walking surface to the opposite concave wall inner surface. These struts may be continuous along the length of the frame, or placed at discrete intervals.

Similarly, as illustrated in FIG. 6, inner struts 104, 106 and 108 are shown in the form of a triangle which have legs extending from the center line above each concave wall to the center line of each adjacent concave wall. As these struts also may extend continuously along the length of the frame, or placed at discrete intervals.

Figure 7:
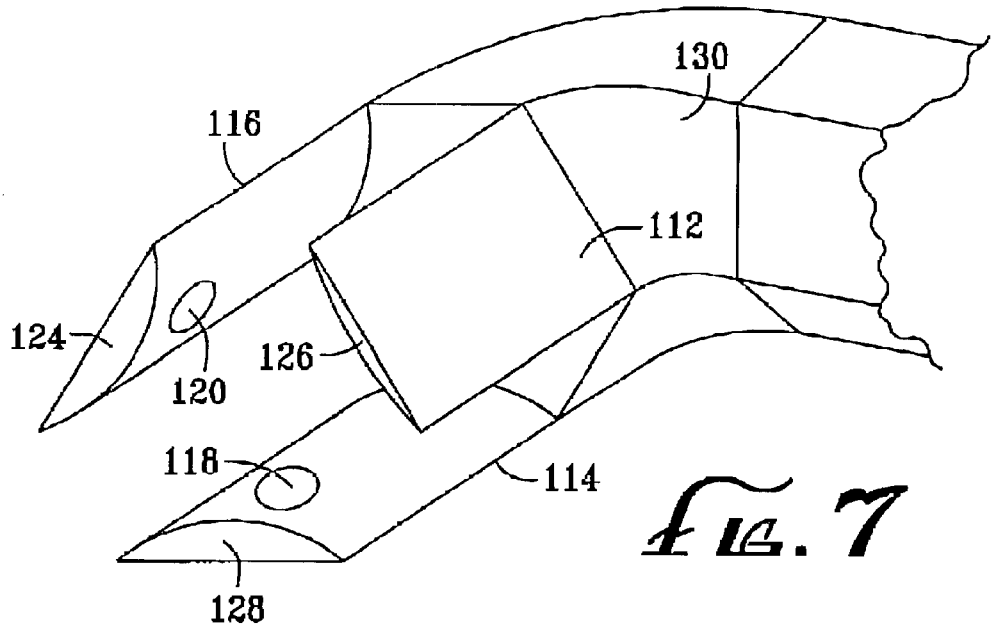
FIG. 7 is a perspective view of an alternate embodiment of the present invention showing lock-in panel capability.
Figure 8:
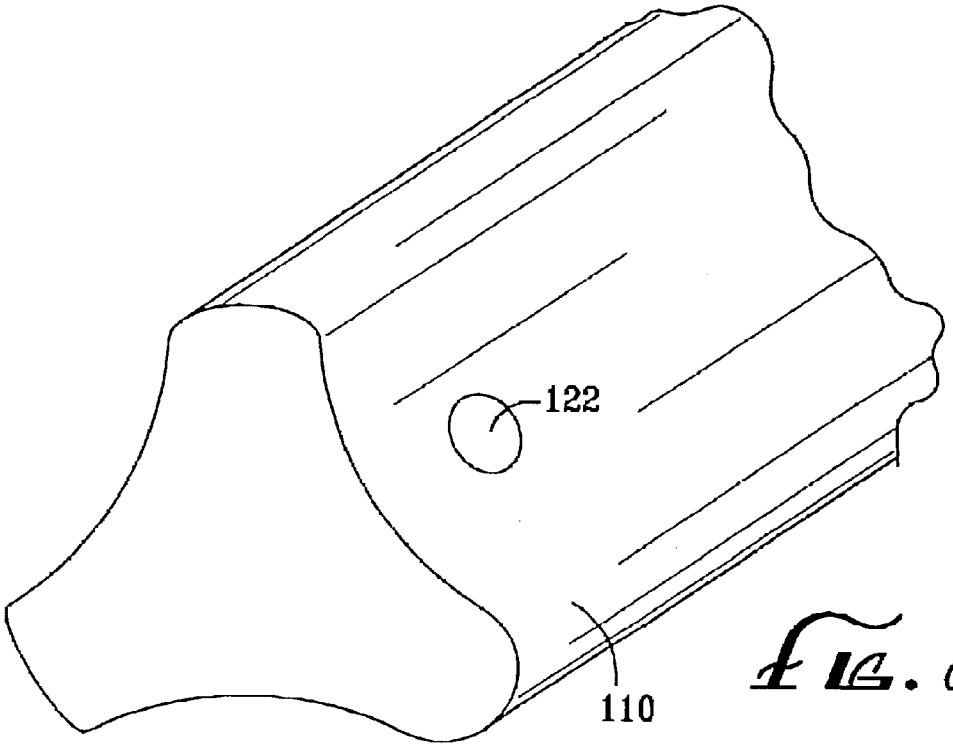
FIG. 8 is a view of the frame of the FIG. 7 embodiment of the present invention.

Referring to FIGS. 7 and 8, an elbow connector and convex wall locking components are illustrated. Shown in FIG. 8 is a triple beam 110 of the present invention and, in FIG. 7, convex locks 112, 114 and 116 are shown. The locks or prongs 112, 114 and 116 are panels which have preferably, one surface flat and a convex surface sized and shaped to conform to the concave wall of the triple beam frame. Each of the panels has at least one peg, or protuberance, shown at 118 for panel 114, and 120 for panel 116. Each protuberance or peg 120, 118 is sized and shaped to snugly fit into a corresponding slot or hole in the concave wall of the triple beam frame, one of which is shown at 122 in FIG. 8. The panels 112, 114 and 116, when locked in place, fit snugly over the three concave side panels of the triple stand. The inner surface of each panel is convex and has a radius of curvature and size so as to snugly fit over the corresponding exterior concave walls of the stand. Each of the panels has a chisel shaped end 124, 126 and 128 that serves as a guide for connecting the stand. These ends function to help the panels to slightly spread outward, thereby creating a tight-fit connection with the stand. The size and positioning of the three prongs 112, 114, and 116 are such as to have a tight, snug fit between the prongs and the body of the stand. Providing bumps or enlarged regions 118, 120, and on the prong 112 (not shown) on the inner surface of each prong, are designed to fit snugly into the "lock" receptacles (concave or hollow) areas on the main frame. However, before reaching these receptacles, the concave areas on each prong will create outward pressure on the prongs when the bumps are in contact with the main frame and have not yet reached their respective receptacles into which they will be forced in by the spring action of the prongs. In addition to these functions, the chisel-like ends work as finger indentations to help the user to manually lift the prongs to disconnect the connectors from the stand. The chisel-like ends of the prongs facilitate the user to open them by slightly tugging on them with the finger in order to disconnect the connector from the main frame.

As shown in FIG. 7, the three panel lock may be formed unitary with an elbow connector 130. The elbow connector 130 may at its opposite end be fashioned to have a similar three-panel lock for connecting to another triple beam. Alternatively, the three panels 112, 114 and 116 might be configured to have a pair of protuberances for each panel and at each end to thus facilitate one side being used to lock one end of a first triple beam frame, and the second side used to lock to an end of a second beam, thereby providing a connection for two triple beams, end to end. The distance between the protuberances and the distances between the concave holes or cavities in the corresponding side panels and concave walls of the triple beams would be selected so as to provide for a snug fit of the end of one beam to the end of another adjacent beam, i.e., the two beams would abut each other, end-to-end.

The top of the elbow is preferably flat for the purpose of providing a visually distinct point where one stand ends and the other begins to discourage the user to step on the connecting element when making a 90 degree transition in traversing the beam. The protuberance is intended to snap into place in the hole on the main frame as a force fit connection.

Figure 9:
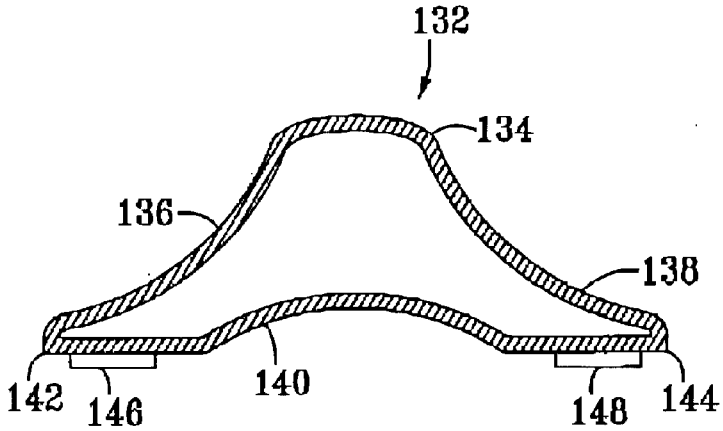
FIG. 9 is a cross-sectional view of another alternate embodiment of the present invention.
Figure 10:
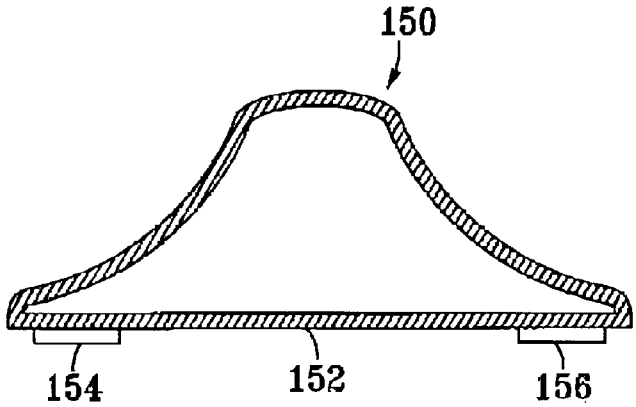
FIG. 10 is a cross-sectional view of another alternate embodiment of the present invention.

Referring to FIGS. 9 and 10, a simplified version of the triple stand or triple beam is illustrated. As shown in FIG. 9, a single stand or single beam 132 is shown in cross-section. The term single stand or single beam refers to the fact that this embodiment has only one walking surface 134, whereas the triple beam has three. The cross-sectional profile of the single beam, as in the triple beam, resembles a Bell Curve shape. The rounded top of the walking surface 134 has a preferred radius in the range of about 1.00 to 1.25 inches. A smaller radius for the walking surface would be preferred for lighter users. This walking surface range provides a walking surface similar to the medium radius walking surface of the triple stand. The side walls 136 and 138 are concave, i.e. bowed inward to provide the same function as in the triple beam, i.e., to enhance strength, and to provide more room for the toes and heels of the user by having the side panels away from the walking surface. This shape also enhances the aesthetic qualities, i.e. shape, style, and overall appearance of the beam.

The bottom wall 140 of the single stand is also concave for the same reason as the bottom of the triple stand, i.e., to provide better stability when the stand is placed on a soft and/or uneven surface like a carpet, rug, floor mat, sand and so forth. The s ingle stand has two flat surfaces, left flat surface 142 and right flat surface 144. Skid resistant pads 146 and 148 may be affixed to the flat surface to further facilitate stability. The single stand embodiment of the invention may incorporate the various features as described in regard to the triple beam embodiment of the invention, such as inserts, different curvatures for the walking surface, different materials of construction, additional internal support structures, and different textures for the walking surfaces.

Referring to FIG. 10, another alternate embodiment of the single stand 150 is shown. The single stand 150 is different from the embodiment of FIG. 9 in that the bottom wall or panel 152 is flat and the skid resistant pads 154 and 156 are affixed to this flat bottom surface, and along the length of the single beam 150. Various other features of the single beam or triple beam may be incorporated into the single beam embodiment 150.

The single stand, as well as the triple stand may, of course, be made out of solid materials such as wood, plastic, formed plastic, marble, granite, metals, or, may be of hollow materials, so long as the materials of construction provide sufficient strength to hold the weight of a user.

Figure 11:
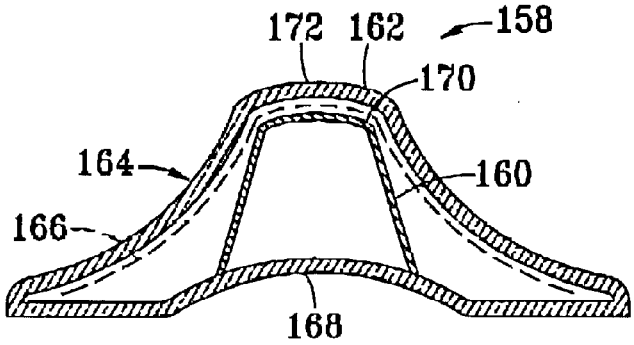
FIG. 11 is a cross-sectional view of another alternate embodiment of the present invention showing another alternate internal support structure.

Referring to FIG. 11, another embodiment of the single beam 158 is shown. As shown in the cross-sectional view of FIG. 11, the single beam incorporates an internal support member 160. The internal support member as shown has a U-shape; however, other shapes such as "T", triangular and so forth may be used, so long as the support member functions to provide additional support for the walking surface 162.

The FIG. 11 embodiment also illustrates another variation of the present walking beam invention in that the frame is made of a transparent, preferably plastic, material. Because the outer walls are transparent, the inner cavity may house a paper insert having art work, logos or other visual materials imprinted thereon. The visual material could then be seen through the transparent walls, thereby providing for changing the appearance of the walking beam with different colors and/or different printed or other visual material on the insert. As illustrated, the walls 164 are transparent and the printed material is shown in dotted lines at 166.

If the supportive arch, or structural member 160 is connected or affixed to the inner surface 168 of the walking surface 162, then two strips of visual material would be required, one on the left side, and one on the right side (not illustrated). However, if the supportive or structural member 160 is not connected to the inner surface of the walking surface, thereby creating a small gap 170 therebetween, then a single strip of insert material 166, as shown in FIG. 11, may be used. This strip would flex and form in the cavity into which it is inserted. In this embodiment it is envisioned that the strength of the frame is sufficient to maintain the gap for normal usage by normal weight persons. However, in the event of unusual loading, such as in the case of an unusually heavy individual or with jumping or other vigorous motion, the weight on the walking surface 162 would be sufficient to close the gap and require the additional support provided by the structural member 160.

Also, shown in FIG. 11, the walking surface 162 has been formed with thin ridges 172. The thin ridges 172 are one variation for surface texture for the walking surface which is intended to improve the frictional contact between the walking surface of the stand and the foot or shoe of the user.

Figure 12:
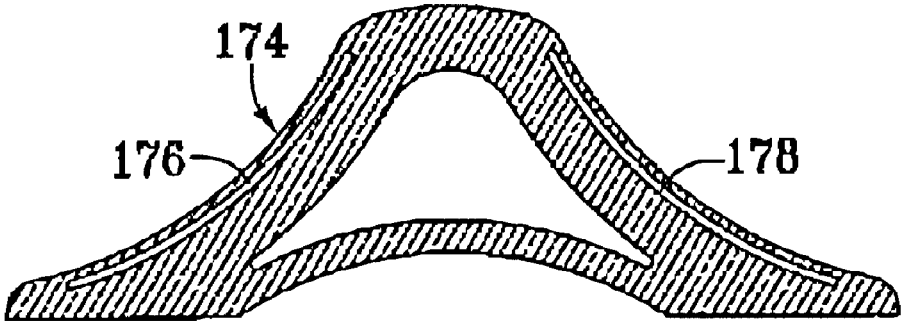
FIG. 12 is another alternate embodiment of the present invention illustrating a transparent frame.

Referring to FIG. 12, alternate embodiment 174 of the single beam is illustrated. In this embodiment the frame is made of clear, transparent material such as plastic. In this embodiment pockets or sleeves 176, and 178 have been formed in the side walls of the frame and close to the surface of the side panels. These slots extend along and up to the entire length of the single beam and provide a cavity into which visual material, as described above, may be inserted.

One important feature or capability of the embodiment of FIG. 12, and other embodiments, in addition to those as described above, when made of clear, transparent material, is that when placed on a "bottomless" floor mat, that is a mat with enhanced depths perception art work, the transparent balance beam would permit the art work to be seen through it, thereby enhancing the visual quality of the balance beam, walking experience.

Figure 13:
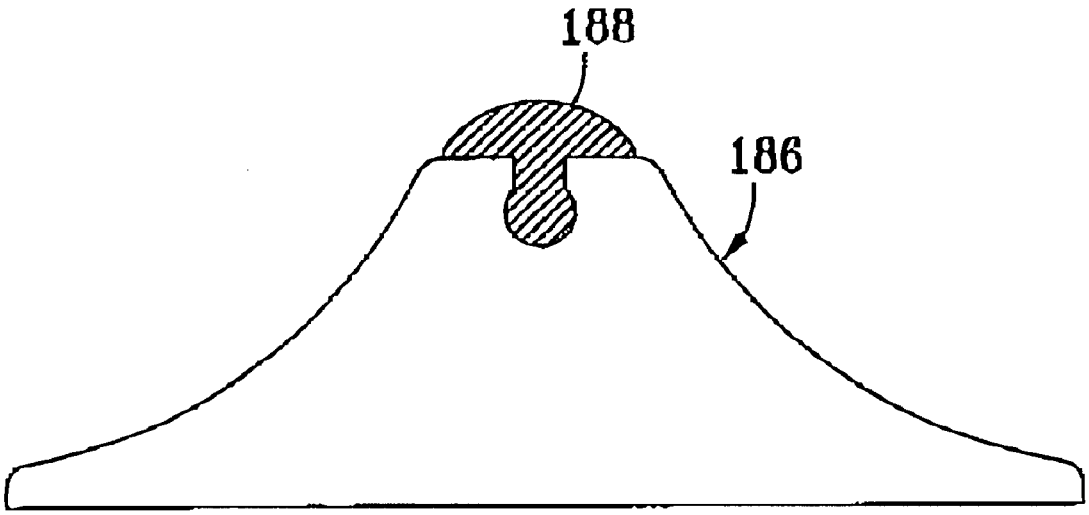
FIG. 13 is a cross-sectional view of another alternate embodiment of the present invention.

FIG. 13 illustrates yet another embodiment of the present invention in which a single beam 186 incorporates a walking surface 188 comprised of an elongated, replaceable insert. The insert 188, as described in greater detail above, may vary in degree of roundness, texture, material of construction and so forth. These inserts may be rounded differently, to provide a range of difficulty levels, from relatively flat, to medium to narrow. The inserts can be made of plastic, wood, rubber, metal or other materials which provide sufficient strength to maintain their shape during use and are of a texture which will assist in keeping the foot or shoe of the user on the walking surface.

Shown in FIGS. 14–27 are various floor mats which might be used under the walking beam to create a visual impression when used in combination with the walking beam of the present invention. Several types of visual impressions may be created such as one to enhance depth perception to create the illusion that one is balancing high off the ground. One purpose for the floor mat is to make the walking beam activity more amusing, challenging and/or interesting. Furthermore, in combination with the walking beam of the present invention, use of an appropriate floor mat may potentially be useful in treating phobias, such as phobias of height, and to increase the level of vestibular stimulation by increasing the challenge level for the user who is walking on the walking beam.

Figure 14:
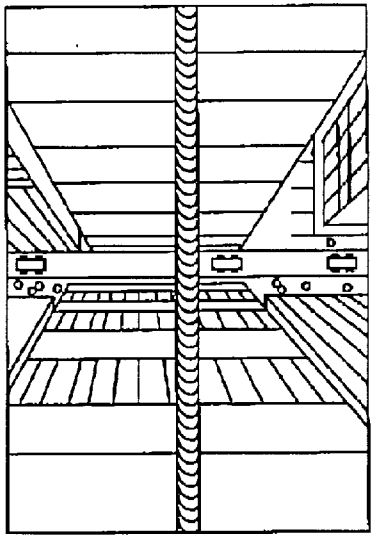
FIGS. 14–27 are various top views of various floor mats which may be used in combination with the walking beam of the present invention.
Figure 15:
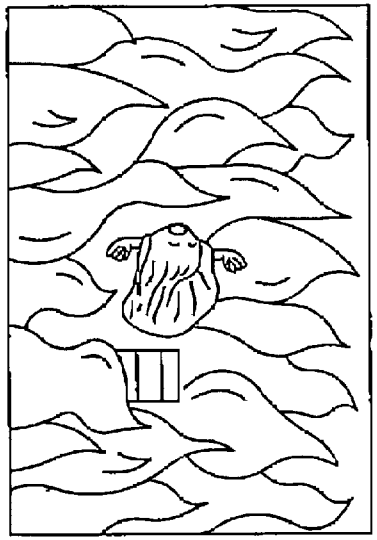
Figure 16:
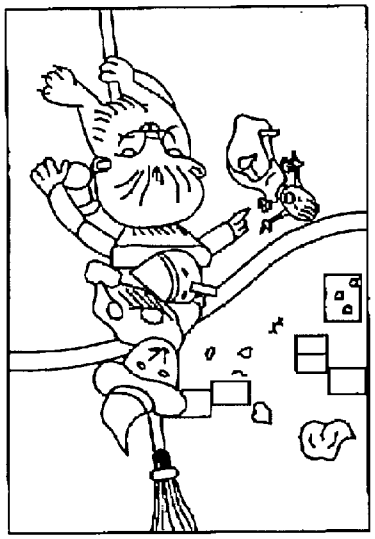
Figure 17:
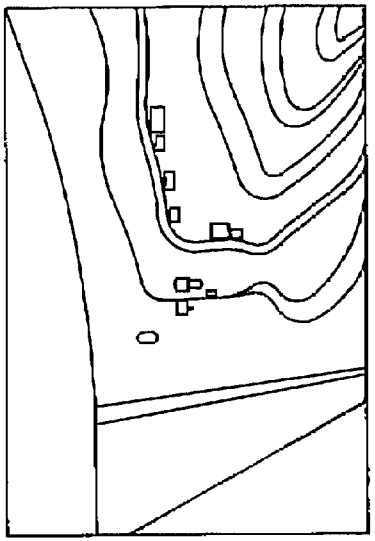
Figure 18:
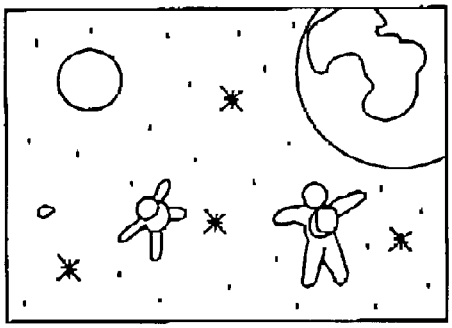
Figure 19:
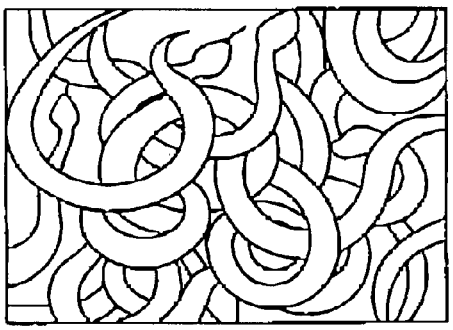
Figure 20:
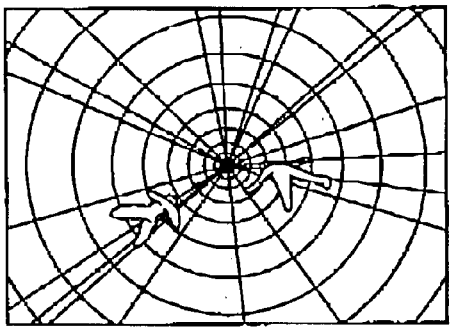
Figure 21:
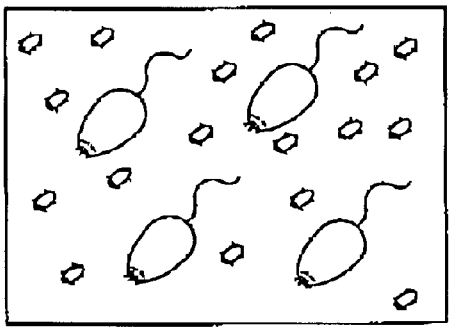
Figure 22:
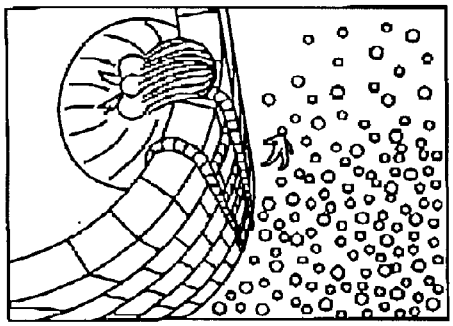
Figure 23:
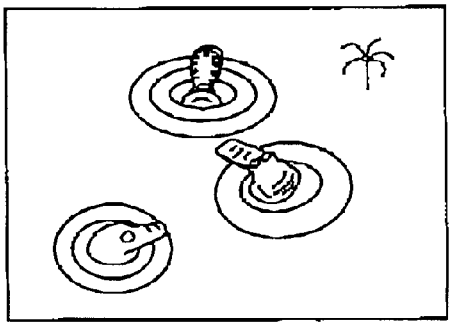
Figure 24:
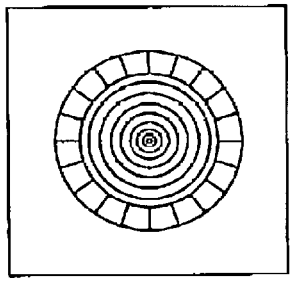
Figure 25:
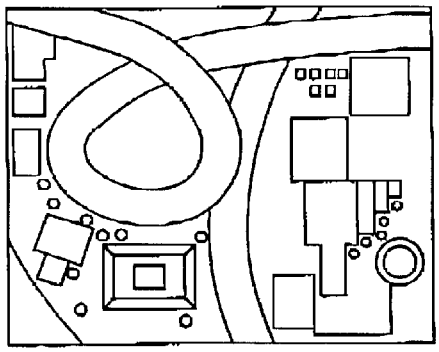
Figure 26:
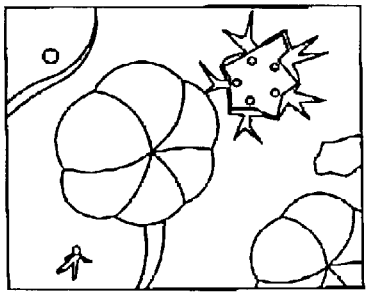
Figure 27:
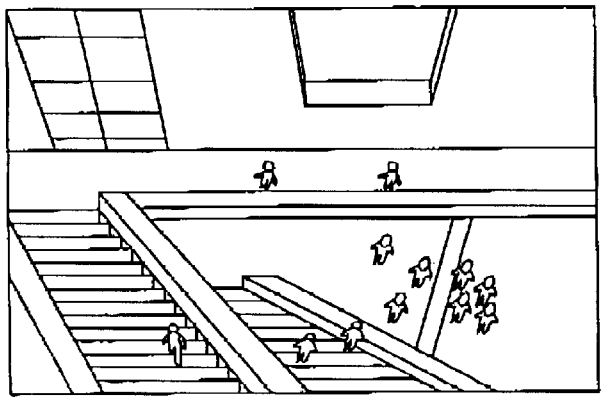

FIG. 14 illustrates a floor mat having view looking down from the top of tall sky scrapers, with the walking beam oriented such that a person walking along the length of the walking beam would have a visual image suggestive that if he or she were walking along a beam stretching from one tall building over the intervening street to the tall building immediately across the street. FIG. 15 illustrates a floor matt with a burning forest, FIG. 16 illustrates a Wizard of Oz scene, and FIG. 17 is a view as if taken from the air showing a building, pier, ship, water, and part of an airplane fuselage and wing. FIG. 18 is a view of astronauts floating in space, FIG. 19 is a scene showing a number of snakes intertwined among each other and FIG. 20 illustrates a time tunnel concept. FIG. 21 illustrates rats and cockroaches, FIG. 22 illustrates a person falling from a high tower down into a crowd below. FIG. 23 is a swamp scene, showing a crocodile in the water. FIG. 24 illustrates a water well, FIG. 25 illustrates a view looking down at a city as, from a helicopter or low flying plane, and FIG. 26 illustrates a parachute diving scene with a background including the ground and/or water. FIG. 27 illustrates a view looking down inside of a building as, for example through an open atrium or the interior of a building which has escalators or a central stairwell.

As may be seen from the detailed description from the various embodiments above, the present invention is advantageous for numerous reasons, particularly, due to the walking surface itself being curved to provide a challenge for balancing and to provide comfort and a natural curve line when standing barefoot or in socks. The degree of curvature may be varied to change the degree of difficulty. Furthermore, the walking surfaces may be equipped with skid-resistant grooves or lined with skid-resistant material such as rubber or sponge to improve friction between the shoes or feet of the user and the contact area itself.

The side panels of the present invention are, preferably, concave so that they are bowed toward the center of the cross-sectional profile of the device. Such concavity provides several important functions such as enhancing the structural capacity of the device, under known principles of design and to minimize the amount of material used and weight of material used. The preferred wall design also minimizes the amount of structure near the outer periphery of the foot, thus making the balancing experience more challenging. The preferred side panels also provide an attractive overall appearance and aesthetics, provide ample surface space to display art work, graphics, logos, promotional and marketing material and thus function as a platform such as a billboard. In one embodiment of the triple stand, each side panel may also serve as a base for the stand when that side is put flat on the floor. The concave side panel in this embodiment becomes an arched base for the stand and, provides good stability even when put on an uneven floor or carpet or rug. The arched base tends to reduce side to side wobbling when the stand is placed on a flat, uneven or carpeted floor. Furthermore, with the single stand embodiment of the present invention, the bottom panel may be concave for the purpose of reducing side to side wobbling when the stand is placed on uneven floors or carpeting as is the case in the triple stand or triple beam embodiments described above.

With respect to the triple stand embodiments, this design is based on the geometry of an equilateral triangle, with side panels being equal in size and 120 degrees apart in orientation to each other. The triple stand embodiments have three walking surfaces, with each surface at an apex of the triangle and curved to a different degree, preferably, from a relatively flat curvature, to medium curvature to a relatively highly curved surface. The varying radiuses serve two purposes: first, to vary the challenge level for balance training and conditioning; and second, to vary the amount of local applied pressure created at the foot from the weight of the body. The purpose of this design is to provide several options for users in terms of local pressure available, so that the individual user may choose a particular walking surface that will yield the preferred applied pressure.

While the present invention has been described in connection with what are presently considered to be the most practical, and preferred embodiments, it is to be understood that the invention is not to be limited to the disclosed embodiments, but to the contrary, is intended to cover various modifications and equivalent arrangements included within the spirit of the invention, which are set forth in the appended claims, and which scope is to be accorded the broadest interpretation so as to encompass all such modifications and equivalent structures.

I claim:

1. A beam comprising:

an elongated generally triangular cross-sectioned frame having a predetermined length;

a first side wall, a second side wall and a third side wall, each of the side walls extending along the predetermined length, being inwardly concave and adapted to lie substantially flat along the predetermined length on a flat surface to thus maintain said frame in a stable position;

a rounded apex formed at the juncture of each of side wall to its adjacent side wall, with each rounded apex having a predetermined radius of curvature and with at least one apex having a radius of curvature different from the radius of curvature of each other apex, whereby a rounded walking surface is provided at each such rounded apex.

2. The beam of claim 1 wherein the radius of curvature for each of the three walking surfaces is different.

3. The beam of claim 1 wherein each of the walking surfaces is convex.

4. The beam of claim 1 wherein each of the walking surfaces is formed as an insert with an anchor portion adapted to conform to and be anchored in a corresponding portion of said frame.

5. The beam of claim 1 further providing internal support members comprising a rigid structure placed inside of said frame.

6. The beam of claim 1 wherein said side walls are transparent.

7. The beam of claim 1 wherein at least one apex has a radius of curvature in the range of about 0.50 inch to about 1.0 inch.

8. The beam of claim 1 further including a mat placed underneath said beam, and said mat containing on it graphical matter selected from the group consisting of depth perception, amusement or challenge creating graphical matter.

9. A method of using the beam of claim 1 comprising the steps of:

placing said beam on a surface sufficiently flat and having a sufficiently large surface area to maintain said beam in a stable position; and walking along said rounded apex.

10. The beam of claim 1 wherein the radius of curvature of one apex is about 0.75 inch.

11. The method of claim 9 wherein the step of providing a rounded apex further includes providing the apex with a radius of curvature of about 0.75 inch.

12. The method of claim 9 further including the step of placing a mat underneath said beam.

13. The method of claim 12 further including the step of providing on said mat graphical matter selected from the group consisting of depth perception, amusement or challenge-creating graphical matter.

* * * * *